US006948536B1

(12) United States Patent
Castro

(10) Patent No.: US 6,948,536 B1
(45) Date of Patent: Sep. 27, 2005

(54) SYSTEM FOR DETECTING LIQUID FUEL BLOCKAGES IN THE VAPOR RETURN LINE OF A FUEL DISPENSER

(75) Inventor: Gilbert Castro, Whittier, CA (US)

(73) Assignee: Hirt Combustion Engineers, Inc., Pico Rivera, CA (US)

( * ) Notice: Subject to any disclaimer, the term of this patent is extended or adjusted under 35 U.S.C. 154(b) by 0 days.

(21) Appl. No.: 10/745,964

(22) Filed: Dec. 26, 2003

Related U.S. Application Data

(60) Provisional application No. 60/436,748, filed on Dec. 27, 2002.

(51) Int. Cl.[7] ..... B65B 1/04
(52) U.S. Cl. ..... 141/83; 141/59
(58) Field of Search ..... 141/83, 59, 392; 222/23, 44, 171, 424; 73/1.57, 1.58, 40, 40.5 R

(56) References Cited

U.S. PATENT DOCUMENTS

| | | | | | |
|---|---|---|---|---|---|
| 3,162,236 | A | | 12/1964 | Wiliams | 431/202 |
| 3,807,940 | A | | 4/1974 | Juricek | 431/202 |
| 3,985,494 | A | | 10/1976 | Childree | 431/202 |
| 3,999,936 | A | | 12/1976 | Hasselmann | 431/202 |
| 4,009,985 | A | | 3/1977 | Hirt | 141/5 |
| 4,058,147 | A | | 11/1977 | Stary et al. | 141/59 |
| 4,118,170 | A | | 10/1978 | Hirt | 431/5 |
| 4,138,880 | A | * | 2/1979 | Cohen et al. | 73/31.07 |
| 4,140,471 | A | | 2/1979 | Stroitz et al. | 431/202 |
| 4,292,020 | A | | 9/1981 | Hirt | 431/5 |
| 4,680,004 | A | | 7/1987 | Hirt | 431/5 |
| 4,960,166 | A | | 10/1990 | Hirt | 431/5 |
| 5,316,057 | A | * | 5/1994 | Hasselmann | 141/94 |
| 5,437,183 | A | * | 8/1995 | Janssen et al. | 73/201 |
| 5,484,000 | A | | 1/1996 | Hasselmann | 141/59 |
| 5,765,603 | A | | 6/1998 | Healy | 141/59 |
| 5,857,500 | A | | 1/1999 | Payne et al. | 141/59 |
| 6,151,955 | A | * | 11/2000 | Ostrowski et al. | 73/40 |
| 6,193,500 | B1 | | 2/2001 | Bradt et al. | 431/5 |

OTHER PUBLICATIONS

"Air to Liquid Volume Ratio", California Environmental Protection Agency; Air Resources Board; Feb. 1, 2001. TP-201.5; pp. 1-13.

* cited by examiner

*Primary Examiner*—Steven O. Douglas
(74) *Attorney, Agent, or Firm*—Stout, Uxa, Buyan & Mullins, LLP; Donald E. Stout

(57) ABSTRACT

A vapor collection testing device is held in one hand and a fuel dispensing nozzle for a fuel dispensing system to be tested is held in the other hand of an operator. The device is slipped over the spout of the nozzle and pushed against the boot of the nozzle (if so equipped), or otherwise pushed sufficiently over the holes on a bootless nozzle so that the nozzle's flow interlock device is opened. Opening the interlock activates the nozzle's lever, to permit fuel dispensing. Without turning the gasoline dispenser on, the nozzle lever is depressed to open the integral vapor valve. At this point, no gasoline is dispensed, but air is ingested by the nozzle and sent into the gasoline storage tank. The air ingestion can be observed by the device's flow meter, in order to determine if there is a liquid flow blockage in the vapor recovery line of the fuel dispensing system.

19 Claims, 9 Drawing Sheets

SYSTEM FOR DETECTING LIQUID FUEL BLOCKAGES IN THE VAPOR RETURN LINE OF A FUEL DISPENSER

This application claims the benefit under 35 U.S.C. 119(e) of the filing date of Provisional U.S. Application Ser. No. 60/436,748, entitled System for Detecting Liquid Fuel Blockages in the Vapor Return Line of a Fuel Dispenser, and filed on Dec. 27, 2002, which application is expressly incorporated herein by reference.

BACKGROUND OF THE INVENTION

This invention relates to a system for controlling gasoline vapor emissions at a service station or stations where liquid gasoline is transferred from one container or tank to another, and more particularly to a simple and effective system for detecting liquid fuel blockages in the vapor return line of a fuel dispenser.

When a vehicle has consumed its supply of gasoline, its gasoline tank is full of gasoline vapors plus a lesser amount of liquid gasoline. During the process of dispensing a fresh supply of liquid gasoline into the tank, the vapor in the tank is displaced into the atmosphere. At the same time, fresh air is drawn down into the service station gasoline storage tank through provided vent pipes.

Gasoline vapors escaping into the atmosphere are a major source of smog and ozone. Fresh air, drawn into the storage tank, stimulates evaporation of the stored gasoline, which converts valuable gasoline into more polluting vapor.

The purpose of state of the art gasoline station vapor control systems is to solve both problems simultaneously; i.e. to prevent the escape of vapors from the vehicle tank and to prevent the ingestion of fresh air into the storage tank.

Because the volume of vapors escaping and the volume of fresh air ingested are approximately equal, the purpose of the system mechanism is to capture the vapors emitted from the vehicle tank and lead them through a conduit to the storage tank. As gasoline is dispensed from the storage tank, the storage tank ingests the vapor displaced from the vehicle tank instead of fresh air.

Pollution control agencies have increasingly mandated strict control standards for release of gasoline vapors into the atmosphere. For example, the California Air Resources Board (CARB) has mandated the following standards for vapor control systems which are identified as "Stage II vapor recovery systems":

1) Highest vapor efficiency in all weather conditions;
2) Zero fugitive emissions (emissions of vapor through unmonitored openings or gaps in a gasoline delivery system);
3) Automatic continuous self-diagnosis;
4) System tolerant of leaks in service station hardware;
5) System simple, tough, reliable, and economical; and
6) System must use best available control technology.

A system which meets the foregoing standards and qualifies as a Stage II vapor recovery system is currently manufactured by Hirt Combustion Engineers, Inc., of Pico Rivera, Calif., the assignee of the present invention, and is described in U.S. Pat. No. 6,193,500, which is herein expressly incorporated by reference.

In order to collect gasoline vapor displaced by refueling vehicles, auxiliary cans, motorcycles, and other vehicles and the like, a Stage II vapor recovery system 10 of the type shown in prior art FIG. 1 must have unobstructed, free flowing passages. When fuel is dispensed from a dispenser 11 to a vehicle 12, the vapor must travel unhindered from the vehicle fuel tank 13 through the dispensing nozzle 14, the coaxial hose 16, the vapor return piping 18, and then into the fuel storage tank 20. A common type of blockage is caused by liquid gasoline in the vapor passage of the coaxial hose 16. Spit-back, top-offs, condensation, and other inevitable operational problems can result in the presence of liquid fuel in the vapor path 21 of the hose 16. When the hose is draped, as is common during dispensing, and shown in prior art FIG. 2, a low point 22 is formed within the vapor path 21 that collects the entrained liquid. If enough liquid is entrained, the vapor path 21 becomes completely blocked. The blockage 23 does not allow the vacuum source to produce vacuum at the dispensing nozzle, as illustrated schematically in prior art FIG. 4. In FIG. 4, there is shown a dispensing nozzle 14 having a nozzle lever 15, which employs a plurality of holes 24 in the spout 26 thereof for collecting vapor generated by the dispensing process. For purposes of illustration, a first pressure gauge 28 having a needle 30 is disposed downstream of the blockage 23, and a second pressure gauge 32 having a needle 34 is disposed upstream of the blockage 23. As can be seen in the figure, the needle 30 in the first pressure gauge 28 is slightly above zero, indicating a slight positive pressure condition at the nozzle within the vapor passage 21, downstream of the blockage 23, while the needle 34 in the second pressure gauge 32 continues to indicate a vacuum condition in the vapor recovery system upstream of the blockage 23. This illustrates that the blockage has effectively prevented the nozzle portion of the system from remaining under a vacuum condition. Since the vacuum must reach the nozzle in order to force the collection of vapors in a "vacuum assist" type of system, this means that the system cannot meet vapor recovery specifications in the presence of such a blockage. As illustrated in FIG. 4, by arrows 35, when a vacuum condition is not maintained at the nozzle 14, fuel vapor as well as liquid fuel will inevitably spray outwardly from the nozzle into the surrounding environment.

A common method for removing excess entrained liquid 23 in the vapor path 21 is the use of a fluid-driven eductor 36, which is often called a "slurpy", as shown in prior art FIG. 3. The slurpy 36 is typically constructed from a venturi 38 which is disposed in the product side or liquid fuel line 40 of the coaxial hose 16. The flow of liquid fuel, typically gasoline, through the venturi 38 during dispensing creates a vacuum. The vacuum pulls the entrained liquid 23 out of the vapor passage 21 and sends it into the product passage or liquid fuel line 40 through a bypass line 42. Thus, this LRD (Liquid Removal Device) causes the liquid fuel to be removed from the vapor path 21 and deposited into the fuel tank 13 of the vehicle 12 (FIG. 1).

However, a problem arises when the slurpy 36 cannot keep up with the rate that liquid fuel is entrained in the hose's vapor passage 21. A faulty slurpy, frequent spit backs, excessive tank top-offs, leaky fittings, and the like can all still permit liquid to fill the vapor path 21 and create a blockage 23.

Another prior art approach commonly employed is to conduct a V/L ratio test to ensure adequate vapor collection (i.e. blockage-free hoses). A flow meter measures the vapor returned, V, during a dispensing episode of L gallons. This test can be conducted with a portable vapor flow meter 44 connected to the spout end of the dispensing nozzle 14, as shown in prior art FIG. 5, or with a permanently installed vapor flow meter 46, which may be disposed in the base of the dispenser 11, as shown in prior art FIG. 6. The portable flow meter 44 allows only spot-checking because such an arrangement is cumbersome, time-consuming, and interferes with a customer's ability to dispense fuel. Additionally, it is difficult to perform, because of the need to dispense fuel to complete the test, requiring an adequate receptacle for receiving the dispensed fuel, and risking environmental damage in the event of a fuel spill, as well as release of fuel vapor to the atmosphere during the test. The permanent flow meter installation 46 is hidden in the dispenser cabinet and allows real time measurement during every fueling event. However, the permanent flow meter option requires a rather expensive low-pressure drop type flow meter, such as a Dresser Roots Meter, located in the base of each dispenser 11.

A problem arises when using the permanent flow meter approach, as shown in FIG. 6. Stage II systems employing "booted" nozzles will return only the vapor available at the vehicle tank fill neck 48. There is no excess air ingestion as with a bootless nozzle. A vehicle employing an Onboard Refueling Vapor Recovery System (ORVR) collects most or the all of the entire volume of vapor displaced during refueling. Thus, there is little or no vapor available to be collected by the booted nozzle. So the permanent flow meter measures little or no vapor collected (i.e. a V/L ratio close to or at zero is recorded). This scenario often signals a false alarm indicating the presence of a blockage 23.

An exemplary prior art V/L ratio test procedure is the California Air Resources Board (CARB) test procedure TP-102.5, the published specifications for which will be cited in a separate Information Disclosure Submission (IDS) in connection with the present patent application. It should be noted that, although the published test specifications reference the test as an A/L, or "Air to Liquid Volume Ratio" test, the "air" term is synonymous with the above referenced "vapor" term, and this is thus an example of the above referenced "V/L Ratio Test". The CARB test is illustrated in FIG. 7. As noted above, in the discussion related to V/L testing procedures, this CARB test method involves pumping a measured volume of liquid gasoline, at a minimum rate, through the dispensing nozzle 14 into a test can 50 while measuring the air volume returning through the vapor recovery path 21 in the nozzle 14. One problem with this V/L test method is that it does not recover the gasoline vapor emitted from the test can 50 during the V/L test. The gasoline vapor, generated during the V/L test, escapes to the atmosphere. Also a risk of spillage exists because the gasoline must be dispensed into a test can 50 and then later returned to the storage tank 20 (FIG. 6).

The test equipment is also clumsy to use. Five separate components, which cannot be held in one hand, are required to perform the V/L test. These components include a spout adapter 52, a flow meter 54, which measures the volume of air ingested in the holes 24 in the spout of the nozzle 14, a hose 56, connecting the spout adapter 52 to the flow meter 54, the test gasoline can 50, and a timing device 58, such as a stop watch, for determining the flow rate. Also, the spout adapter 52, flow meter 54, and timing device 58 must be used in a very precise manner to ensure an accurate result, or the test will be invalid.

Additionally, the air ingested by the dispensing nozzle during the V/L test causes evaporation of the gasoline in the facility's storage tank. The evaporation of gasoline pressurizes the storage tank and causes fugitive gasoline vapor emissions. The liquid gasoline dispensed during the V/L test is returned to the gasoline storage tank after the test is completed. The return of the liquid gasoline from V/L testing to the gasoline storage tank also causes pressurization and hence fugitive vapor emissions.

What is needed, therefore, is a testing device which can, in a simple manner, without modification to the nozzle or dispenser, test to determine that the system vacuum is, or is not, present in the vapor return passage in the nozzle.

SUMMARY OF THE INVENTION

The inventive testing system is applicable to any system that uses vacuum to assist in the collection of vapors at the nozzle. The purpose of the system is to 1) permit testing of the vapor collection performance of the dispenser without pumping liquid gasoline or releasing gasoline vapor to the atmosphere, 2) reduce the collection performance test equipment to a single hand-held component, and 3) create a system that is not complicated and is user friendly.

A vapor collection testing device in accordance with the invention is held in one hand and a fuel dispensing nozzle for a system to be tested is held in the other hand of an operator. The device is slipped over the spout of the nozzle and pushed against the boot of the nozzle (if so equipped), or otherwise pushed sufficiently over the holes on a bootless nozzle so that the nozzle's flow interlock device is opened. Opening the interlock activates the nozzle's lever, to permit fuel dispensing. Without turning the gasoline dispenser on, the nozzle lever is depressed to open the integral vapor valve. At this point, no gasoline is dispensed, but air is ingested by the nozzle and sent into the gasoline storage tank. The air ingestion can be observed by the device's flow meter.

A lack of sufficient collection performance, such as is caused by a blockage or low vacuum level, will be indicated by a low flow rate. Excessive collection performance, such as is caused by a high vacuum level, will be indicated by a high flow rate. Normal collection performance will be indicated by a normal flow rate.

More particularly, in one aspect of the invention there is disclosed a fuel vapor emission control system which comprises a fuel storage tank and a dispenser having a nozzle with a spout for dispensing fuel into a vehicle. The nozzle is fluidly connected to the fuel storage tank via a coaxial hose, which permits flow of liquid fuel, preferably gasoline, from the storage tank to the nozzle through a first flow passage, and vapor through a second flow passage back into said storage tank. The inventive system further comprises a testing device for use in cooperation with the nozzle, which comprises a vapor collection receptacle adapted to receive the nozzle spout and a flow meter for detecting a rate of fluid flow through the nozzle. In a preferred embodiment, the vapor collection receptacle comprises a boot, and the flow meter is fluidly attached to an end of the receptacle which is opposite to an end of the receptacle which is engaged with the nozzle.

In another aspect of the invention, there is disclosed a testing device for testing the vapor collection efficiency of a fuel vapor emission control system comprising a fuel storage tank, and a dispenser having a nozzle with a spout for dispensing fuel into a vehicle. In the emission control system, the nozzle is fluidly connected to the fuel storage tank and the coaxial hose includes a first flow passage for permitting flow of fuel from the storage tank through the nozzle, and a second flow passage for permitting flow of vapor from the nozzle back to the fuel storage tank. The inventive testing device comprises a vapor collection receptacle adapted to receive the nozzle spout of the fuel dispenser, as well as a flow meter for detecting a rate of fluid flow through the second flow passage of the nozzle.

In yet another aspect of the invention, there is described a method for testing the vapor collection performance of a fuel dispenser in a fuel vapor emission control system comprising a fuel storage tank and a dispenser having a nozzle with a spout. As is known in the prior art, in such a system the nozzle is fluidly connected to the fuel storage tank by means of a coaxial hose which includes a first flow passage for permitting flow of fuel from the storage tank through the nozzle, and a second flow passage for permitting flow of vapor from the nozzle back to the fuel storage tank. The inventive method comprises steps of attaching a testing device to the nozzle spout, so that fluid flow is permitted between the testing device and the nozzle spout, and then detecting the flow of air through the nozzle spout. In a preferred method, the testing device comprises a receptacle for fluidly attaching the testing device to the nozzle spout, and the attaching step includes a step of opening a flow interlock device on the nozzle, so that a handle of the nozzle is actuated.

Still further, the preferred method comprises a step of depressing the nozzle lever, with the dispenser turned off, so that no gasoline may be dispensed, after the attaching step to thus open an integral vapor valve in the second flow passage of the coaxial hose.

In the preferred method, the detecting step is performed by a flow meter attached to the receptacle on the testing device. The method preferably further comprises a step of clearing a liquid blockage in the second flow passage if the detecting step detects a flow of air below a predetermined level through the spout.

Furthermore, the attaching step of the preferred method comprises inserting an end of the nozzle spout into an aperture in the receptacle.

The invention, together with additional features and advantages thereof, may best be understood by reference to the following description taken in conjunction with the accompanying illustrative drawing.

DESCRIPTION OF THE PREFERRED EMBODIMENT

Figure 8A:
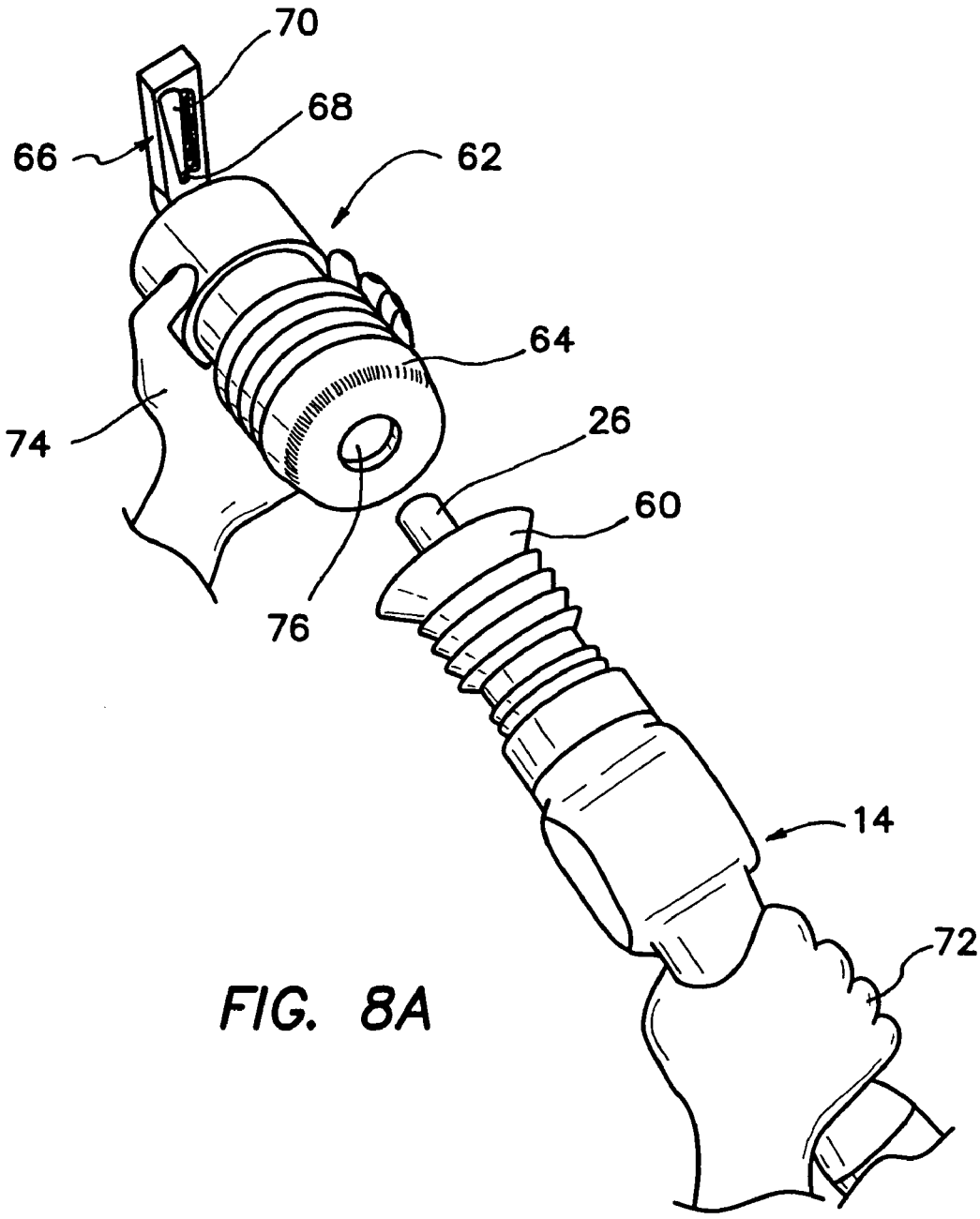
FIGS. 8A and 8B are perspective views, in sequence, of a test procedure using the inventive equipment.
Figure 8B:
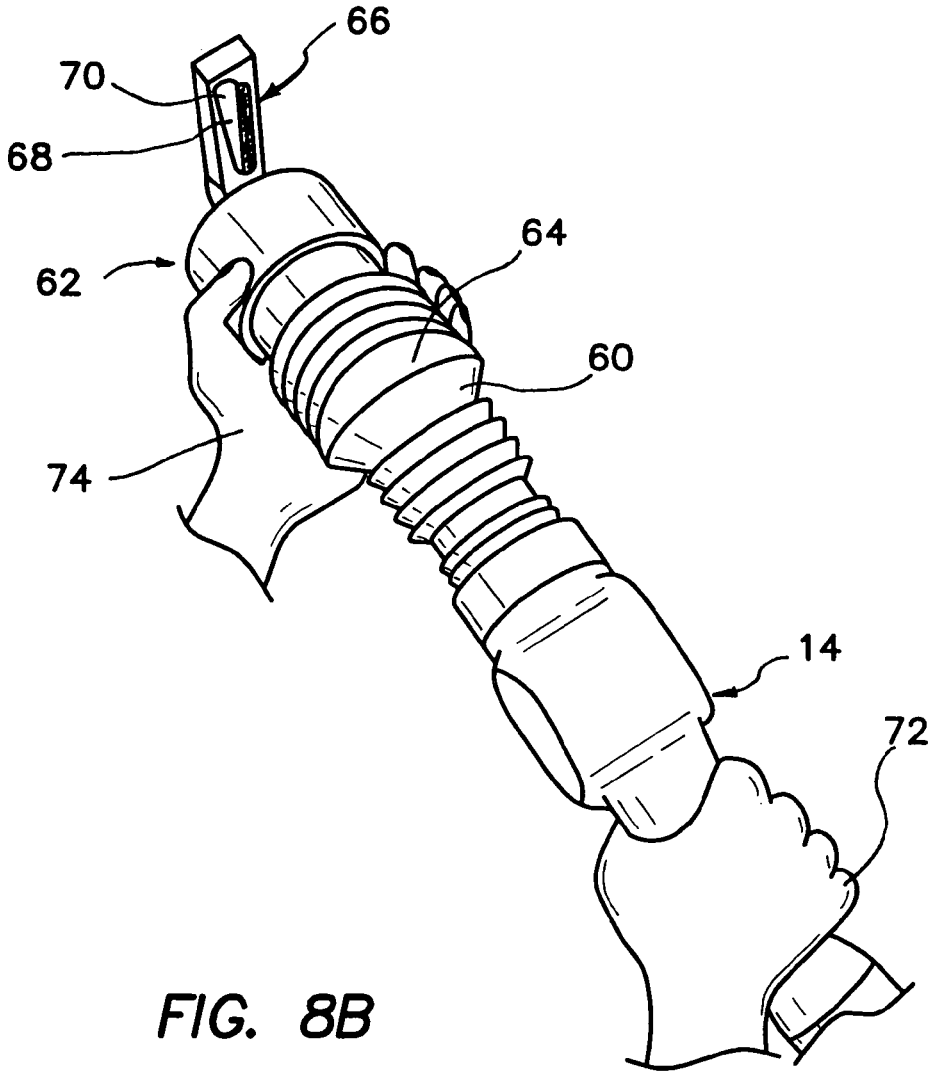

Referring now, in particular, to FIGS. 8A and 8B, there is shown in each figure a dispensing nozzle 14 of prior art construction, equipped with a spout 26 and a boot or cup 60. It should be noted that the present invention is applicable, with suitable adaptation, to any type of booted or bootless nozzle. In the case of a bootless nozzle, for optimal performance, some sort of cup 60 surrounding the spout 26 should be employed.

Figure 1:
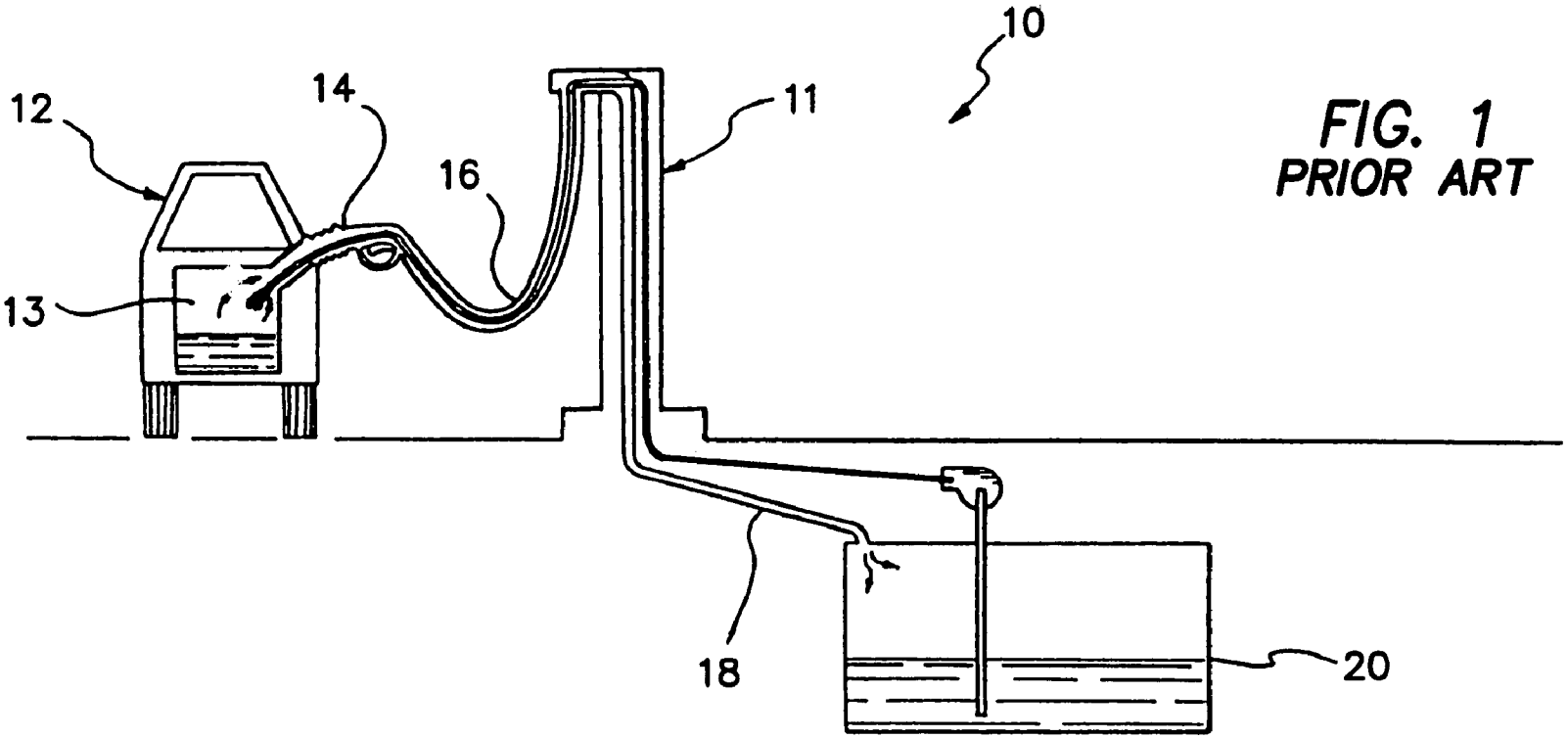
FIG. 1 PRIOR ART
FIG. 1 is a schematic view of a prior art fuel dispensing system.
Figure 2:
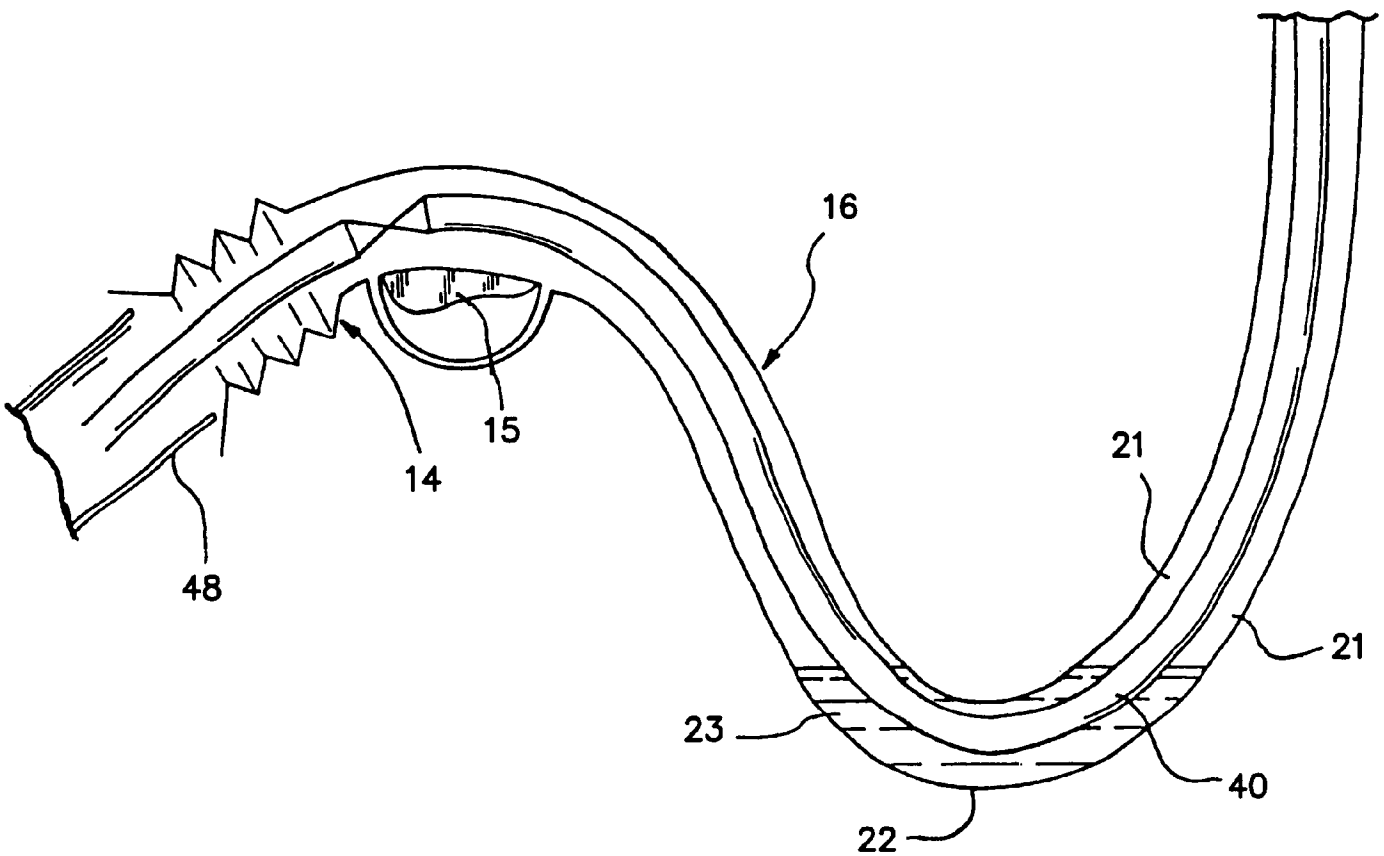
FIG. 2 PRIOR ART
FIG. 2 is a schematic view of a portion of the system of FIG. 1, illustrating a blockage in the hose thereof.
Figure 3:
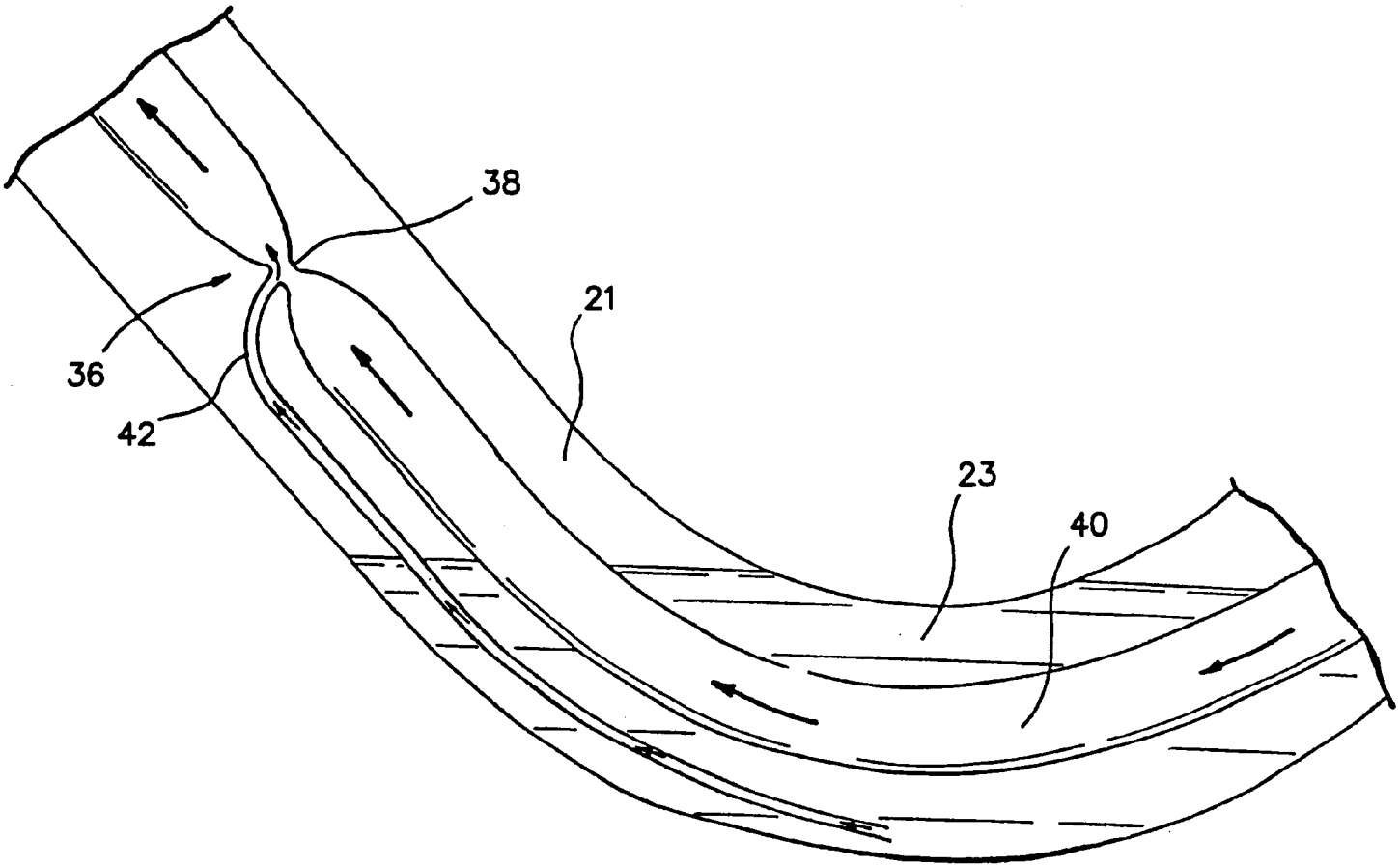
FIG. 3 PRIOR ART
FIG. 3 is a schematic view of a portion of the system shown in FIG. 2, showing the blockage in greater detail.
Figure 4:
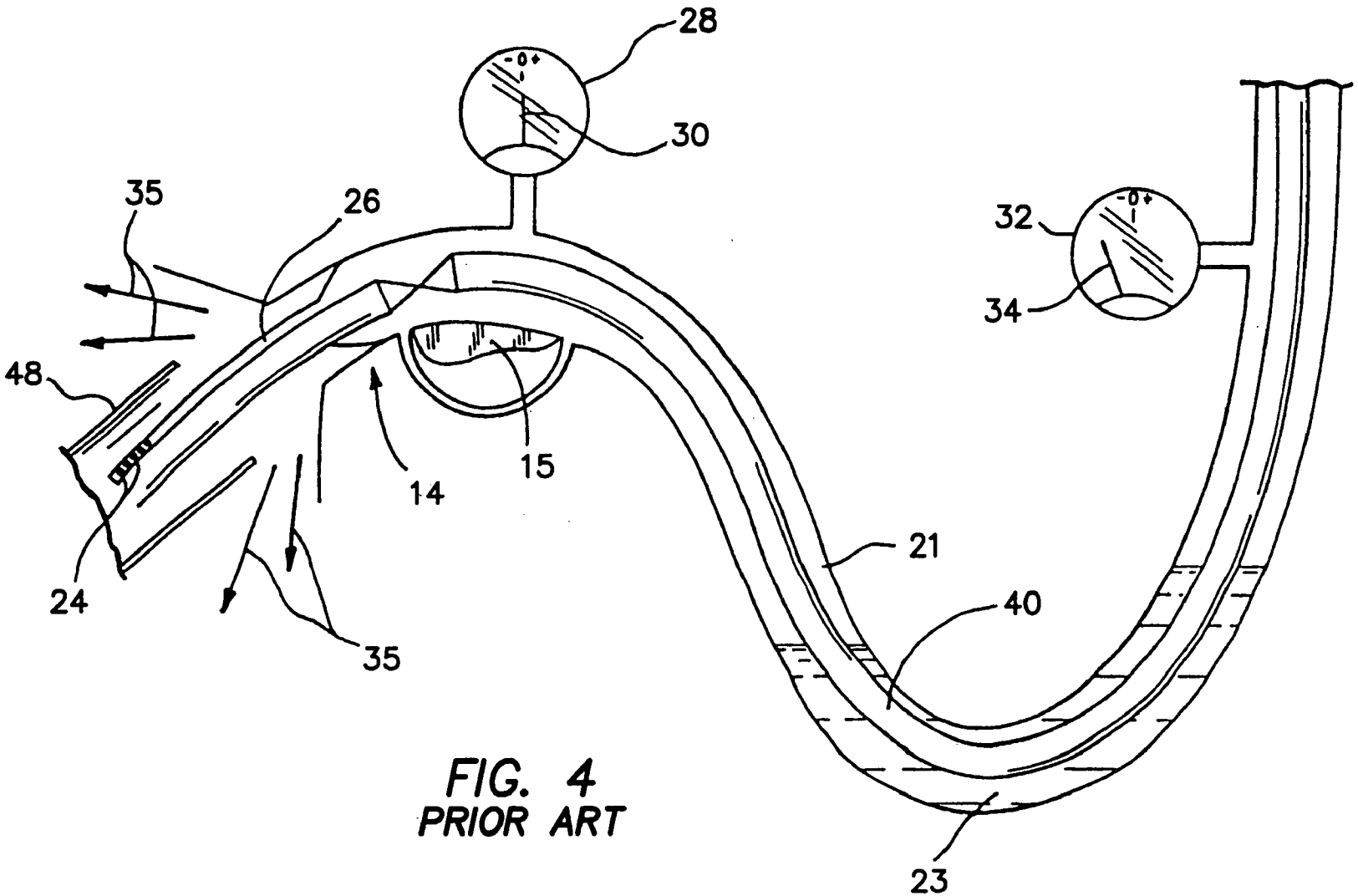
FIG. 4 PRIOR ART
FIG. 4 is a schematic view similar to FIG. 2, showing the effect of the blockage in reducing vacuum at the nozzle.
Figure 5:
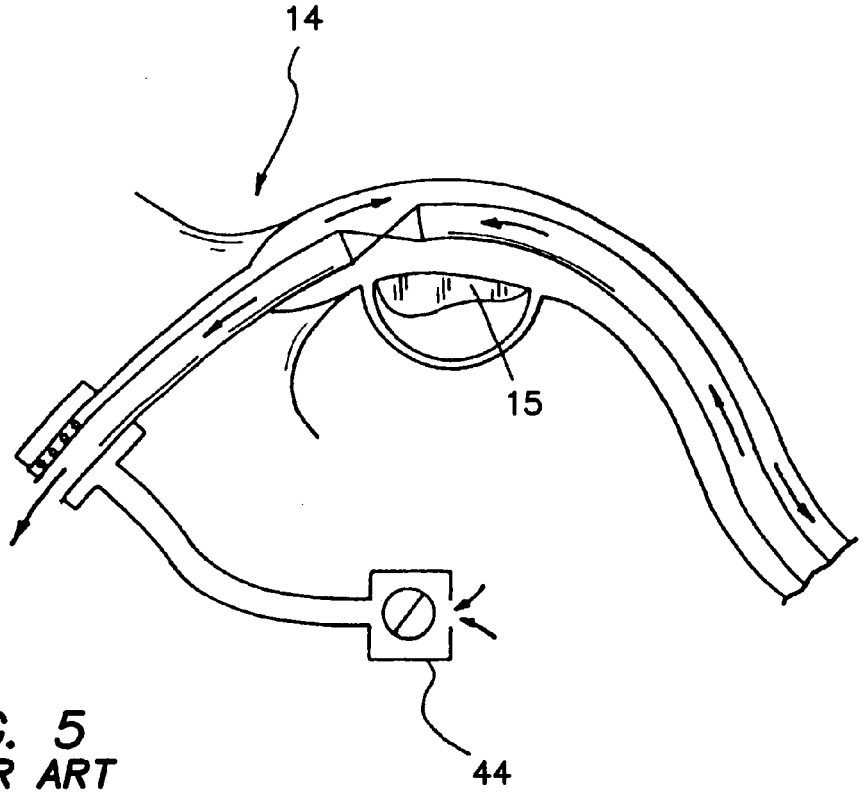
FIG. 5 PRIOR ART
FIG. 5 is a schematic view illustrating a prior art solution for detecting blockages of the type shown in FIGS. 2–4.
Figure 6:
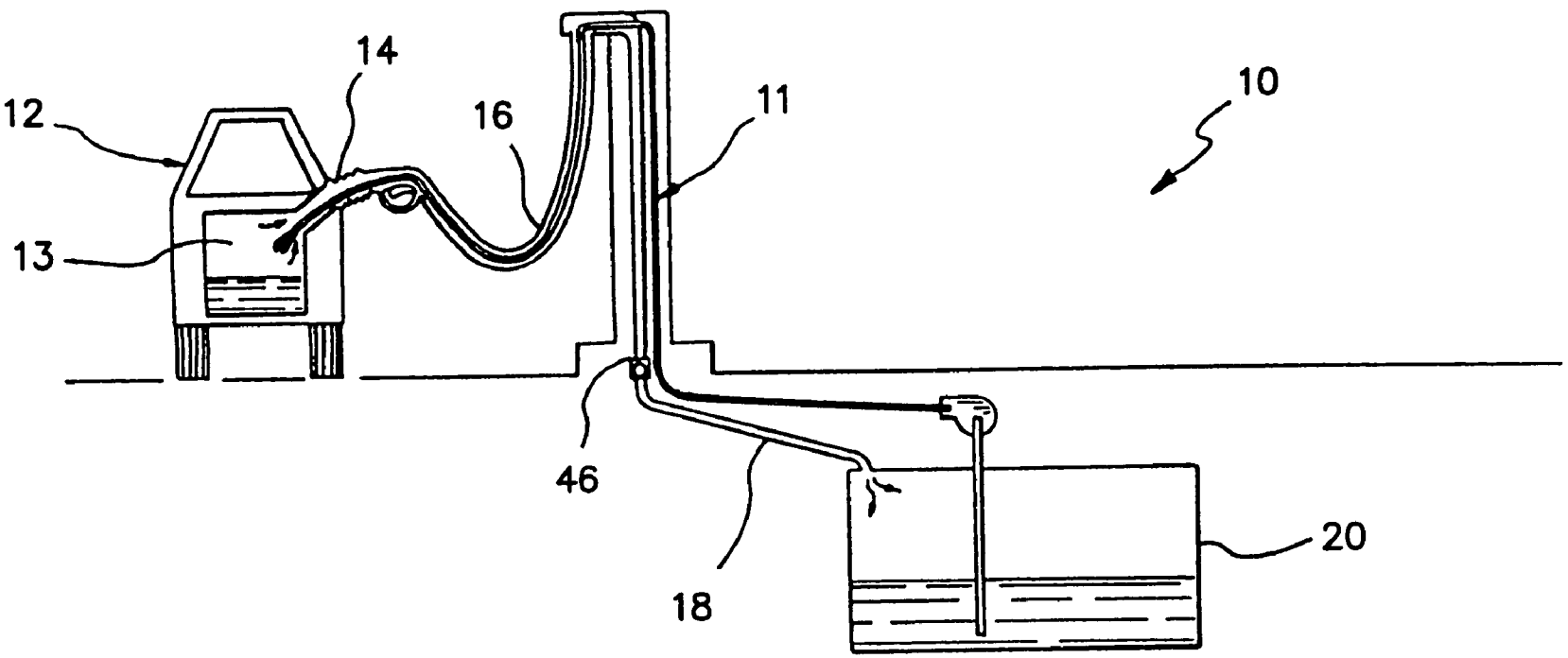
FIG. 6 PRIOR ART
FIG. 6 is a schematic view illustrating another prior art solution for detecting blockages of the type shown in FIGS. 2–4.
Figure 7:
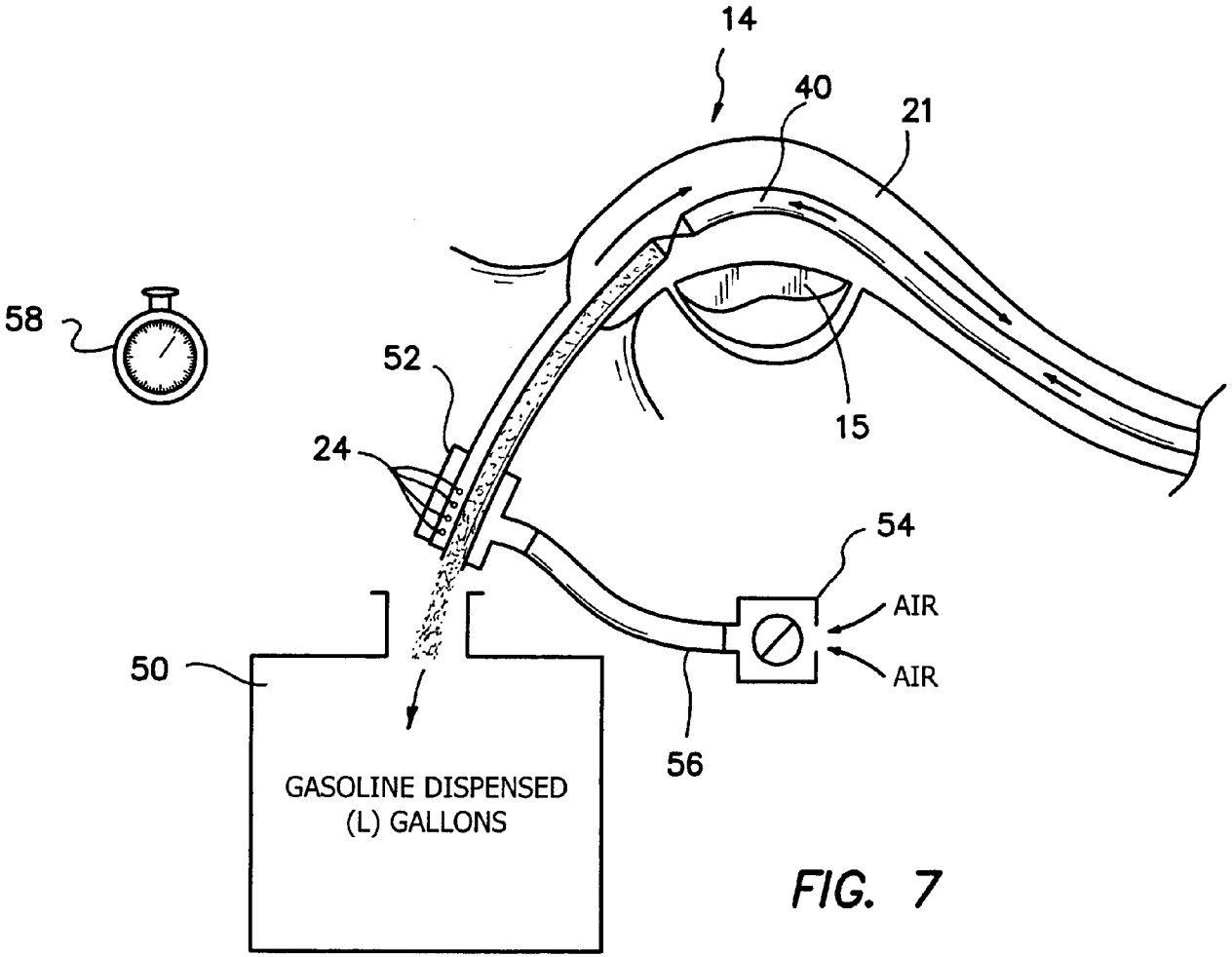
FIG. 7 is a schematic view of yet another prior art blockage test procedure.

A device 62 constructed in accordance with the principles of this invention is also shown in both FIGS. 8A and 8B. The device 62 comprises, in a presently preferred embodiment, a vapor collection boot or receptacle 64, as might be used on a nozzle, and a miniature flow meter 66, of known construction, having an indicating pointer 68 which may be directed to an appropriate region, such as a red or green region, of an indicating dial 70. In use, a gasoline station attendant may hold the nozzle 14 in one hand 72, and the inventive device 62 in the other hand 74, as shown in FIG. 8A. He or she then presses the boot 64 of the device 62 against the boot or cup 60 of the nozzle 14, such that they engage one another, as shown in FIG. 8B, with the spout 26 of the nozzle 14 disposed within a complementary aperture 76 in the receptacle 64. This opens the nozzle's flow interlock device, which activates the nozzle's lever 15, so that actuation of the lever permits fuel flow through the nozzle 14 when the dispenser is turned on. Then, with the dispenser turned off, so that no gasoline may be dispensed from the nozzle 14, the attendant depresses the nozzle lever 15 (FIG. 4), thus opening the nozzle's integral vapor valve (not shown). This action exposes the flow meter 66 of the device 62 to the vacuum inside the hose, particularly, inside the vapor flow passage 21 (FIG. 4). If vacuum is present, confirming that the dispenser hose is not blocked, atmospheric air will be ingested by the nozzle, because of the vacuum condition, and sent through the vapor recovery hose 21 into the gasoline storage tank. This air ingestion will cause airflow through the flow meter 66, thus moving the pointer 68 into a region on the indicating dial 70 which indicates air flow above a predetermined level (identified as the "green region" in a preferred embodiment). On the other hand, if the hose is blocked, and vacuum is thus not present, or is below standard, no or little air flow will occur, and the flow meter will so indicate by having the pointer 68 remain in a region on the indicator dial 70 which indicates a lack of air flow above the aforementioned predetermined level (identified as the "red region" in a preferred embodiment). Suitable corrective action to remove the discovered blockage can then be taken.

Of course, the above described embodiment is only exemplary. Other known flow meter systems, for example, could be employed, including systems providing digital readout, and the like.

A particular advantage of the inventive system is that it is relatively inexpensive, and is easily utilized by a typical service station attendant with minimal training. Additionally, the test performed by the system is very quick, minimizing downtime of the associated dispenser. Importantly, it may be used with any existing fuel dispensing system having a vapor recovery feature, without modification of such system.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A fuel vapor emission control system, comprising:

a fuel storage tank;

a dispenser having a nozzle with a spout for dispensing fuel into a vehicle, wherein when said dispenser is turned on, gasoline may be dispensed, and when said dispenser is turned off, gasoline cannot be dispensed;

a coaxial hose for permitting flow of fuel from said storage tank through said nozzle through a first flow passage, and for permitting flow of vapor through a second flow passage back into said storage tank; and a testing device for use in cooperation with said nozzle, said testing device comprising a vapor collection receptacle adapted to receive said nozzle spout and a flow meter for detecting a rate of fluid flow through said nozzle while said dispenser is turned off.

2. The system as recited in claim 1, wherein said vapor collection receptacle comprises a boot.

3. The system as recited in claim 1, wherein said flow meter is fluidly attached to an end of said receptacle which is opposite to an end of the receptacle which is engaged with the nozzle.

4. A testing device for testing the vapor collection efficiency of a fuel vapor emission control system comprising a fuel storage tank, a dispenser having a nozzle having a spout for dispensing fuel into a vehicle, and a lever for selectively permitting fluid flow through said nozzle, whereby the nozzle is fluidly connected to the fuel storage tank through a coaxial hose and the coaxial hose includes a first flow passage for permitting flow of fuel from the storage tank through said nozzle, and a second flow passage for permitting flow of vapor from the nozzle back to the fuel storage tank, said testing device comprising:

a vapor collection receptacle adapted to receive the nozzle spout of the fuel dispenser and to engage and open a flow interlock device on said nozzle, thereby activating said lever; and a flow meter for detecting a rate of fluid flow through the second flow passage of the nozzle.

5. The testing device as recited in claim 4, wherein said vapor collection receptacle comprises a boot.

6. The testing device as recited in claim 4, wherein said flow meter is fluidly attached to an end of said receptacle which is opposite to an end of the receptacle which is engageable with the nozzle.

7. A method for testing the vapor collection performance of a fuel dispenser in a fuel vapor emission control system comprising a fuel storage tank, a dispenser having a nozzle having a spout, wherein the nozzle is fluidly connected to the fuel storage tank by a coaxial hose which includes a first flow passage for permitting flow of fuel from the storage tank through said nozzle, and a second flow passage for permitting flow of vapor from the nozzle back to the fuel storage tank, said method comprising:

attaching a testing device to the nozzle spout, so that fluid flow is permitted between said testing device and said nozzle spout; and detecting the flow of air through said nozzle spout without dispensing fuel through said nozzle.

8. The method as recited in claim 7, wherein said testing device comprises a receptacle for fluidly attaching the testing device to the nozzle spout, and said attaching step includes a step of opening a flow interlock device on said nozzle, so that a lever of the nozzle is actuated.

9. The method as recited in claim 8, and further comprising a step of depressing the nozzle lever, with said dispenser turned off, after said attaching step to thus open an integral vapor valve in the second flow passage of the coaxial hose.

10. The method as recited in claim 9, wherein said detecting step is performed by a flow meter attached to said receptacle on said testing device.

11. The method as recited in claim 7, and further comprising a step of clearing a liquid blockage in said second flow passage if said detecting step detects a flow of air below a predetermined level through said spout.

12. The method as recited in claim 8, wherein said attaching step comprises inserting an end of said nozzle spout into an aperture in said receptacle.

13. A method for testing the vapor collection performance of a fuel dispenser in a fuel vapor emission control system comprising a fuel storage tank, a dispenser having a nozzle having a spout, wherein the nozzle is fluidly connected to the fuel storage tank by a coaxial hose which includes a first flow passage for permitting flow of fuel from the storage tank through said nozzle, and a second flow passage for permitting flow of vapor from the nozzle back to the fuel storage tank, said method comprising:

attaching a testing device to the nozzle spout; and engaging a flow interlock device in said nozzle to thereby permit the flow of fluid through said nozzle without inserting said nozzle into a fuel tank filling spout.

14. The method as recited in claim 13, and further comprising a step of detecting the flow of air through said nozzle spout without dispensing fuel through said nozzle.

15. The method as recited in claim 13, wherein said testing device comprises a receptacle for fluidly attaching the testing device to the nozzle spout, and said attaching step includes a step of opening a flow interlock device on said nozzle, so that a lever of the nozzle is actuated.

16. The method as recited in claim 15, and further comprising a step of depressing the nozzle lever, with said dispenser turned off, after said attaching step to thus open an integral vapor valve in the second flow passage of the coaxial hose.

17. The method as recited in claim 16, wherein said detecting step is performed by a flow meter attached to said receptacle on said testing device.

18. The method as recited in claim 15, and further comprising a step of clearing a liquid blockage in said second flow passage if said detecting step detects a flow of air below a predetermined level through said spout.

19. The method as recited in claim 15, wherein said attaching step comprises inserting an end of said nozzle spout into an aperture in said receptacle.

* * * * *